299-13 SR
8/12/80 XR 4,216,998

United States Patent [19]
Bowen et al.

[11] 4,216,998
[45] Aug. 12, 1980

[54] METHOD OF UNDERGROUND MINING BY PILLAR EXTRACTION

[76] Inventors: Ray J. Bowen, 1879 Delann, Salt Lake City, Utah 84121; William R. Bowen, 1636 Sunnydale La., Salt Lake City, Utah 84108

[21] Appl. No.: 44,391

[22] Filed: May 31, 1979

[51] Int. Cl.[3] ..... E21C 41/04
[52] U.S. Cl. ..... 299/11; 299/13; 299/18
[58] Field of Search ..... 299/11, 13, 18

[56] References Cited

U.S. PATENT DOCUMENTS

| | | | |
|---|---|---|---|
| 1,597,023 | 8/1926 | Drennen | 299/18 |
| 2,358,687 | 9/1944 | Cassidy et al. | 299/11 |
| 2,846,205 | 8/1958 | Bucky | 299/11 |
| 4,030,752 | 6/1977 | Simpson | 299/11 |

*Primary Examiner*—Ernest R. Purser
*Attorney, Agent, or Firm*—Thorpe, North & Gold

[57] ABSTRACT

A method of sublevel caving and pillar and top coal extraction for mining thick coal seams includes the advance mining of rooms and crosscuts along the bottom of a seam to a height of about eight feet, and the retreat mining of the top coal from the rooms, crosscuts and portions of the pillars remaining from formation of the rooms and cross-cuts. In the retreat mining, a pocket is formed in a pillar, the top coal above the pocket is drilled, charged and shot, and then the fallen coal is loaded by a continuous miner so that the operator remains under a roof which has not been shot. The top coal from that portion of the room adjacent the pocket is then mined, and another pocket is formed in the pillar. The top coal above the second pocket is mined followed by the mining of the top coal of that portion of the room adjacent the second pocket, all by use of a continuous miner which allows the operator to remain under a roof portion which has not been shot.

10 Claims, 4 Drawing Figures

METHOD OF UNDERGROUND MINING BY PILLAR EXTRACTION

The Government has rights in this invention pursuant to Contract No. U.S.D.O.E. ET-76-C-01-9115 (formerly U.S.B.M. J0265009) awarded by the U.S. Department of Energy.

BACKGROUND OF THE INVENTION

This invention relates to a method of mining thick underground coal seams in such a way that the operator of mining machinery may remain under supported mine roofs during the mining operation.

A large percentage of underground coal seams are relatively thin (nine feet or less) and because of this, most underground coal mining methods and machinery have been developed to mine such seams. These methods are not generally suitable or safe for mining thick coal seams (greater than about twelve feet in thickness), but because there are substantial reserves of thick, deep coal, a number of other mining methods have been proposed and tried. One of these, known as "top slicing," involves the driving of rooms and crosscuts against the bottom of the seam, the shooting and loading of enough roof coal to enable the roof rock to be bolted, and then the slabbing of pillar ribs and the loading of remaining broken coal by miners under the bolted ribs. This method exposes the miners to high ribs and thus the greater possibility of cave-ins and slough-offs. Also, a very strong roof is necessary for this method to be successful.

Another method, known as "bench mining," requires the use of mining machinery known as continuous miners. With this method, rooms, crosscuts and pillar pockets or splits are driven against the top of the seam which is then bolted. The top portion of the remaining pillars are then mined by additional cuts that can be reached by the continuous miner with the operator positioned under the bolted roof. The continuous miner is then used to mine downwardly through the floor to recover the bottom coal.

In each of the above-described methods, the miners must work under high roof conditions with the attendant problems of making high ribs safe and of providing adequate ventilation along the high ribs. Because of these problems, thick seams are generally not fully mined, leaving much valuable but unrecovered coal.

OBJECTS AND SUMMARY OF THE INVENTION

It is an object of the invention to provide a new, improved and safer method of underground mining of thick coal seams.

It is another object of the invention to provide such a method which utilizes pillar extraction, and mining of top coal from protected areas under an unmined and supported roof.

It is a further object of the invention to provide a method of underground mining in which retreat mining of top coal in a roof area is carried out while advance mining is performed in another area so that the amount of area being mined at a time is minimized.

It is also an object of the invention to provide such a method in which thick coal seams may be mined without requiring the miners to work under high roofs and ribs.

The above and other objects are realized in a specific illustrative method of mining thick, underground coal seams in which the seam is advance mined along the bottom thereof to form rooms, crosscuts and pillars. At the same time that a room is being advance mined, another room which has previously been advance mined is retreat mined. The retreat mining is performed by forming a pocket in a pillar, drilling, charging and shooting the top coal above the pocket, and loading the fallen top coal by a continuous miner. The continuous miner is positioned with the operator's cab or seat under a roof which has not been shot. The top coal above a portion of the adjacent room is then drilled, charged, shot and loaded, followed by the formation of another pocket in the pillar, etc.

BRIEF DESCRIPTION OF THE DRAWINGS

The above and other objects, features and advantages of the invention may be best understood from a consideration of the following detailed description presented in connection with the accompanying drawings in which.

DETAILED DESCRIPTION

Figure 1:
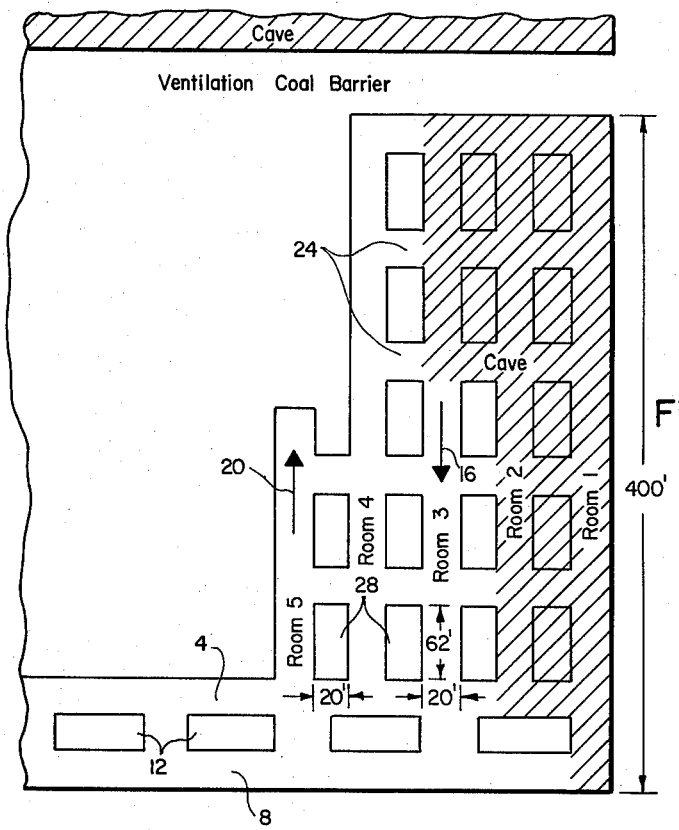
FIG. 1 is a top plan view schematic of a room, crosscut and pillar arrangement illustrating the present mining method invention.

In FIG. 1 there is shown a top schematic view of a room, crosscut and pillar arrangement for an underground coal mine. Access to the area of mining activity is had through two so-called section entries 4 and 8 which are separated by pillars 12. The section entries branch from main entries (not shown) which lead to other sections to be mined. This is all conventional in underground coal mining operations.

Five rooms or partial rooms are shown as having been formed in the FIG. 1 view, with the mining of rooms 1 and 2 and part of room 3 having been completed, as indicated by the shading. Room 3 is being retreat mined as indicated by arrow 16, room 5 is being advanced mined as indicated by arrow 20, and the advance mining of room 4 has been completed but no retreat mining has been done. Each room illustratively is 400 feet in length and 20 feet in width. Crosscuts 24 are driven (mined) at right angles to the rooms and illustratively are 18 feet in width. Pillars 28 separate the rooms and crosscuts and illustratively are 20 feet in width and 62 feet in length.

The advance mining of rooms and crosscuts is carried out by driving openings along the bottom of a thick seam of coal so that the floor of the opening is generally coincident with sub-seam strata. As will be described later, forming the advance openings along the bottom of the seam facilitates subsequent mining of the top coal in a safe and efficient manner in accordance with the present invention. Also, driving the advance openings along the bottom of the seam reduces coal dust generated by machine travel on the floor and establishes an inert floor. The advance openings are made about eight feet high which should be sufficient to accommodate utility and ventilation equipment installation. The height also permits use of machinery which is suitable for mining thick seams.

As indicated in FIG. 1, the number of rooms being mined at a time is limited to three, with one room being advance mined (room 5), one being retreat mined (room 3), and one being provided as an escapeway (room 4). The advance mining and retreat mining are balanced to progress at about the same speed so that as the retreat mining of one room is completed, the advance mining of another room is completed and the mining operation can be shifted to a new room for advance mining and a new room for retreat mining. By limiting the number of rooms in the mining section at a time to three, the amount of time the pillars must stand to support the top coal before being extracted themselves is minimized. This adds to the safety of the method of the present invention. Also, with the dimensions for the rooms and pillars given above, by limiting the number of rooms to three, the zone of development or mining is maintained relatively narrow so that the above seam rock strata is not cantilevered too great a distance over the area being mined.

Figure 2:
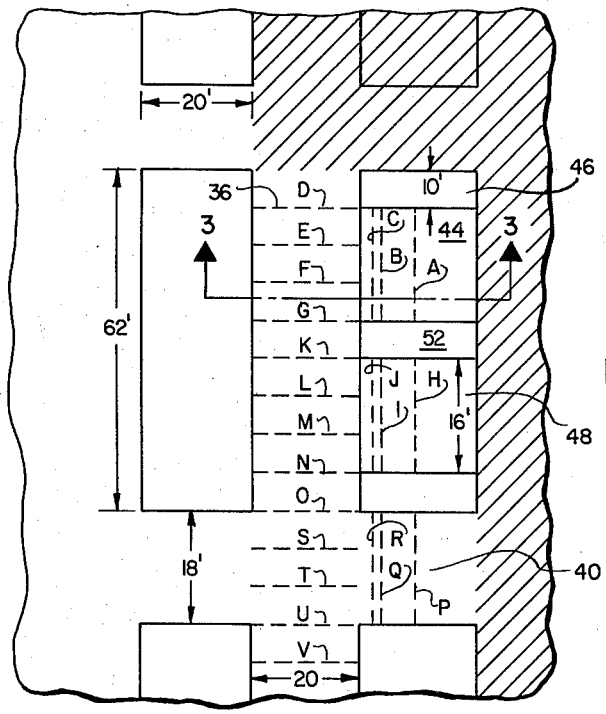
FIG. 2 is a top plan view schematic of a pillar and the manner in which the pillar would be extracted in accordance with the present invention.
Figure 3:
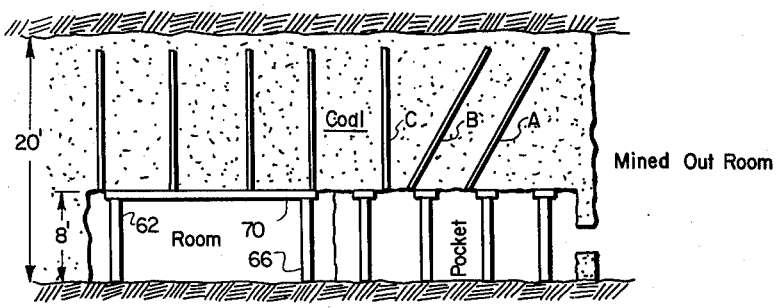
FIG. 3 is an end cross-sectional view, taken along lines 3—3 of FIG. 2, of a room and pillar pocket.

FIG. 2 shows a top, plan view schematic of rooms, crosscuts and pillars and illustrates how the pillars and top coal would be mined in accordance with the present invention. The shaded area, as with FIG. 1, represents that portion of the mine which has been completed and a pillar 32, and the top coal of a room 36 and crosscut 40 are the areas to next be mined. Such mining is carried out by first removing the coal from a portion of the pillar 32 to form a pocket or split 44, leaving a fender 46. The pocket would be formed up to the height of the roof of room 36 which would be about eight feet, and would have a width of about sixteen feet. The fender would be about ten feet in width. The roof of the pocket 44 would then be drilled and charged with explosives in preparation for 'shooting'. Rows of blast holes are drilled transversely in the roof of the pocket along lines A, B, and C, with each hole being spaced from the adjacent holes by about four to six feet. The blast holes of rows A and B are drilled at about a 30° angle with respect to the vertical, sloped in the direction of the previously mined area, as illustrated in FIG. 3 (which is an end, cross-sectional view of the pillar 32 and room 36 taken along lines 3—3 of FIG. 2). The blast holes along line C are drilled vertically upwardly as also indicated in FIG. 3. The blast holes are drilled to within about six inches of the top or roof of the coal seam which, in FIG. 3, is represented as being about 20 feet thick. The angling of the holes as shown helps confine the fall of coal, when it is shot, to an area within reach of the gathering arms of coal-loading equipment such as the well-known continuous miner. The holes of row C are drilled vertically upwardly so that the coal brow between the room 36 and pocket 44 will extend generally from the roof of the room 36 vertically upwardly. A coal brow of this formation helps maintain a safe and competent top coal roof in the room 36. The rows of blast holes, except for rows B and C, are spaced from six to seven feet apart.

After shooting the top coal in the pocket 44, a continuous miner 100 (FIG. 4) or other suitable loading equipment is used to load the fallen coal into a shuttle car 104 or other coal carrying apparatus. This will be discussed more in detail later. Placement and shooting of the blast hole rows A, B, and C results in leaving a roof bridge extending from fender 46 to the remaining portion of the pillar 32 over pocket 44. This serves to maintain the strength and competence of the unmined top coal roof.

After the fallen coal in pocket 44 has been loaded, then a portion of the top coal in room 36 is mined by charging and shooting previously drilled blast holes along line D (FIG. 2). This leaves a roof bridge extending from a pillar 50 to fender 46. The fallen coal is then loaded after which blast holes along lines E, F, and G are charged and shot and the resulting fallen coal loaded. Next, another pocket 48 is driven in the pillar 32, leaving fenders 52 and 56 on either side thereof. The top coal in the pocket 48 is then drilled along lines H, I, and J, as before discussed, and charged and shot for subsequent loading. The sequence of shooting the remaining top coal in the room 36 in crosscut 40 is as follows:

K; L, M, N; O; P, Q, and R; and S, T, U, and V.

Figure 4:
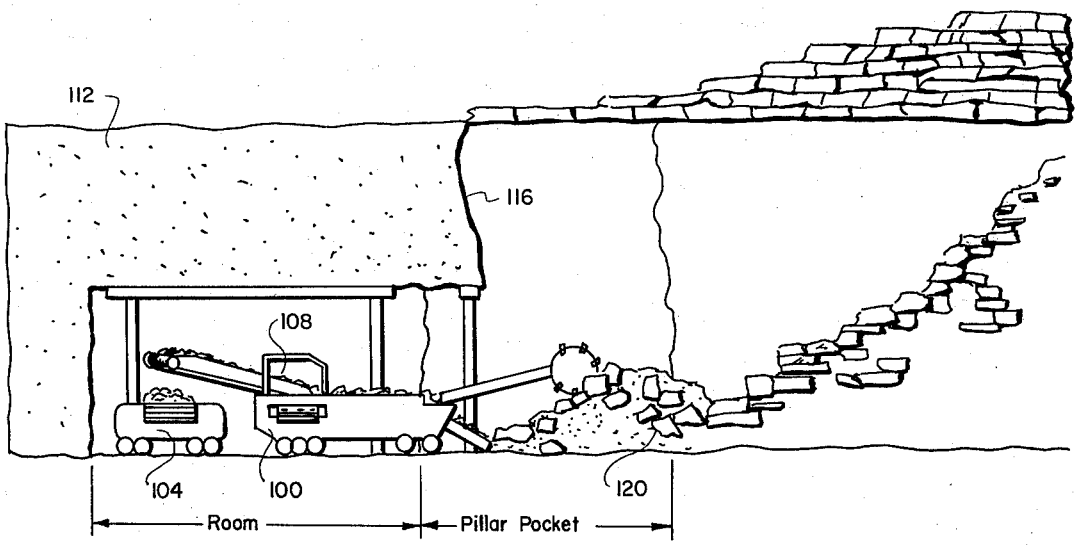
FIG. 4 is an end cross-sectional view of a room and pillar pocket showing a continuous miner loading fallen top coal.

With this method of mining the pillars and top coal, small increments of top coal can be recovered without exposing miners to high ribs and roofs. This is because mining machinery such as the continuous miner can be utilized to load the fallen coal, with the operator remaining in a position under a supported and unmined roof of a room or crosscut. This is illustrated in FIG. 4 which shows a cab or operator's position 108 of the continuous miner 100 positioned under the supported coal roof 112 of a room back from a brow 116 of the top coal. The arms of the continuous miner 100 extend into the pillar pocket to gather the fallen top coal 120. If very large increments of top coal are mined, then it becomes necessary for the miners to operate machinery under a high roof which is very dangerous as earlier discussed.

FIG. 3, in addition to showing the pattern of drill holes, also illustrates the type of roof support structure which might be utilized in the present invention, at least under adverse conditions. The support structure includes hydraulic jacks or props 62 and 66 spaced on either side of the room, and an aluminum or steel box section cross bar 70 placed on top of the props and extending therebetween to support the top coal roof. Such supporting structure would be set in place as the room and crosscuts are advance mined. Such supporting structures would be emplaced without the necessity of removing the continuous miner from its mining position. Each set of jacks and crossbars would be spaced about four feet apart or more closely as required along the length of the room. Jacks and crossbars would also be placed in the pockets concurrently with the mining of same. This support structure provides additional safety for the miners and enables the miners to work completely under supported roofs while mining the top coal of the seam. This, of course, was not practical with prior thick seam mining methods. After drilling and charging of top coal above support structure is completed, the support structure is removed in preparation for shooting.

If the conditions of the mine are favorable, then the supporting structure might simply consist of single wooden posts as are conventionally used. Of course, those in control of the mining operation would have to determine the advisability of using the different types of supporting structure.

As earlier discussed, it is important for reasons of efficient use of equipment and safety to balance the advance and retreat mining in the rooms. Specifically, it has been found that with the use of a continuous miner, the time to advance mine in a room an area sufficient to create one pillar is determined by time necessary to retreat mine the top coal from a pillar and adjacent room area. Thus, the continuous miner can be used to load at one time all coal produced by the firing of a charge of explosives, and then moved to advance mine for the purpose of creating another pillar. When the next charge of explosives has been detonated in the retreat mining room, the continuous miner is then moved to the location of the coal produced by the explosion, where it remains until all such coal has been leaded. In this manner, the continuous miner is used to the full extent possible.

In the manner described, a novel, safe and efficient method of mining thick coal seams is provided. The safety features derive from carrying out the mining operations in such a way that the miners are not exposed to high and dangerous ribs and roofs. This is made possible by mining the top coal of the seam in small increments as described, and by limiting the number of rooms (or the size of the zone of development) so that the length of time the pillars are used for support is minimized, and so that the amount of above-seam rock strata cantilevered above the mining work area is limited.

It is to be understood that the above-described processes are only illustrative of the application of the principles of the present invention. Numerous modifications and alternative arrangements and processes may be devised by those skilled in the art without departing from the spirit and scope of the invention, and the apended claims are intended to cover such modifications and processes. For example, although the underground mining method has been described for mining thick coal seams, the method could also be used for mining other bedded deposits such as salt, potash, trona, gypsum, oil shade, etc.

What is claimed is:

1. A method of mining seams of underground material comprising (a) advance mining the seam along the bottom thereof to form generally parallel rooms and parallel crosscuts having generally a first height, leaving a plurality of spaced-apart pillars, and (b) retreat mining the top material from the rooms, crosscuts, and portions of the pillars, said retreat mining being carried out while advance mining is performed and including (b.1) forming a first pocket in a pillar to leave a fender on one or both sides thereof and recovering the material from the pocket, (b.2) drilling, charging and shooting the top coal above the pocket, (b.3) loading the fallen top coal by machinery which allows the operator thereof to remain in a position adjacent to the fallen coal under a roof which has not been shot, and (b.4) charging, shooting, and loading the top coal above that portion of the room adjacent to the pocket and fenders.

2. A method as in claim 1 wherein said retreat mining further comprises forming a second pocket in the pillar to leave fenders on both sides thereof and recovering the material from the second pocket, and performing steps (b.2), (b.3), and (b.4) for the second pocket.

3. A method as in claim 2 wherein advance mining is carried out to form a room while retreat mining is carried out in a previously advance mined room which is one room removed from the room being advance mined, so that no more than three rooms at a time are formed.

4. A method as in claim 2 wherein said drilling of the top coal is done by drilling blast holes at an angle from the vertical sloped upwardly away from those portions of the roofs which have not been shot.

5. A method as in claim 4 wherein a row of blast holes is drilled generally vertically at the opening of a crosscut or pocket from a room, said row extending transversely of the opening.

6. A method as in claim 4 wherein said blast holes are angled at about 30° with respect to the vertical.

7. A method as in claim 4 wherein said blast holes are drilled in rows extending transversely of the rooms, crosscuts, and pockets, with the spacing between blast holes being about five to six feet, the spacing between rows in the crosscuts and pockets being about five feet, and the spacing between rows in the rooms being about six to seven feet.

8. A method as in claim 7 wherein said first height is about eight feet, and wherein the rooms are about twenty feet wide, the crosscuts are about eighteen feet wide, the pillars are about twenty by sixty-two feet in thickness with the long dimension of the pillars being generally parallel with the rooms, the pockets are about sixteen feet wide formed transversely in the pillars, and the fenders are about ten feet wide.

9. A method as in claim 2 further comprising placement of prop and crossbar roof supports in the rooms and crosscuts as the rooms and crosscuts are advance mined.

10. A method as in claim 9 further comprising removing the prop and crossbar roof supports after drilling and charging blast holes and before shooting such blast holes.

* * * * *